US011214985B1

(12) United States Patent
Hawkins et al.

(10) Patent No.: US 11,214,985 B1
(45) Date of Patent: Jan. 4, 2022

(54) ELECTRO-MECHANICAL LATCH WITH COCKING MECHANISM

(71) Applicant: Moog Inc., East Aurora, NY (US)

(72) Inventors: Glen C. Hawkins, South Jordan, UT (US); John A. Andrews, Blairsville, GA (US); Robert G. Pace, Andrews, NC (US)

(73) Assignee: Moog Inc., East Aurora, NY (US)

( * ) Notice: Subject to any disclaimer, the term of this patent is extended or adjusted under 35 U.S.C. 154(b) by 571 days.

(21) Appl. No.: 15/883,907

(22) Filed: Jan. 30, 2018

Related U.S. Application Data

(60) Provisional application No. 62/456,249, filed on Feb. 8, 2017.

(51) Int. Cl.
*E05B 47/00* (2006.01)
*E05B 17/20* (2006.01)
*E05B 47/06* (2006.01)

(52) U.S. Cl.
CPC ..... *E05B 47/06* (2013.01); *E05B 17/2011* (2013.01); *E05B 47/0005* (2013.01); *Y10T 292/14* (2015.04)

(58) Field of Classification Search
CPC ..... Y10T 292/14; E05B 17/2011; E05B 47/0005; E05B 47/06
See application file for complete search history.

(56) References Cited

U.S. PATENT DOCUMENTS 1,428,566 A 9/1922 Timmerman
2,408,560 A * 10/1946 Keehn ..... B25B 31/005 411/344
2,786,383 A * 3/1957 Bachman ..... F16B 21/165 411/348
3,011,805 A * 12/1961 Johnson ..... F16L 39/00 285/124.1
3,140,721 A * 7/1964 Sullivan ..... F16K 17/003 137/73
3,214,195 A * 10/1965 Zahuranec ..... F16L 37/56 285/27
3,430,305 A * 3/1969 Geffner ..... B64D 17/383 24/603

(Continued)

OTHER PUBLICATIONS

"Suspension, Arming, and Releasing Equipment" —Aviation Ordnanceman, Chapter 10, 10-1-10-3 (Jul. 2001).

*Primary Examiner* — Carlos Lugo
(74) *Attorney, Agent, or Firm* — Harter Secrest & Emery LLP

(57) ABSTRACT

A ball-latch mechanism comprising a plunger supported in a housing and linearly movable from a loaded to an extended position, a trigger rotatable from a latched position, which interferes with linear movement of the plunger, to an unlatched position, which permits linear movement of the plunger from the loaded position, a bias element biasing the plunger from the loaded position, a cocking mechanism comprising a lever arm rotatable about a lever axis from a retracted position within the housing, wherein a bearing surface of the lever arm is outside of a range of motion of the plunger, and a cocked position, wherein the bearing surface of the lever arm bears against the plunger and the plunger is in the loaded position, whereby the plunger may be forced to the loaded position by the lever arm by application of torque to a torque receiving surface of the lever arm.

9 Claims, 3 Drawing Sheets

(56) References Cited

U.S. PATENT DOCUMENTS

| | | | | | |
|---|---|---|---|---|---|
| 3,584,544 | A * | 6/1971 | Haberman | F15B 15/261 92/24 |
| 3,730,005 | A * | 5/1973 | Hjermstad | B64D 1/06 74/2 |
| 3,764,172 | A * | 10/1973 | Standke | E05B 47/0002 292/15 |
| 3,980,327 | A | 9/1976 | Duran | |
| 4,071,271 | A | 1/1978 | Alkan | |
| 4,512,597 | A * | 4/1985 | Nabb | E05B 63/121 292/143 |
| 4,635,452 | A * | 1/1987 | Agbay | E05B 67/365 70/34 |
| 4,890,635 | A | 1/1990 | Gray, Jr. | |
| 4,891,994 | A * | 1/1990 | Barba | E05B 47/0002 251/68 |
| 5,004,003 | A | 4/1991 | Gray, Jr. | |
| 5,298,088 | A | 3/1994 | Gray, Jr. | |
| 5,428,873 | A | 7/1995 | Hitchcock et al. | |
| 8,083,274 | B2 | 12/2011 | Caldwell et al. | |
| 8,220,298 | B2 | 7/2012 | Burke et al. | |
| 9,297,401 | B2 * | 3/2016 | Langlais | F16B 21/165 |
| 2011/0277520 | A1 | 11/2011 | Nunuparov | |

* cited by examiner

ELECTRO-MECHANICAL LATCH WITH COCKING MECHANISM

TECHNICAL FIELD

The present invention relates to electro-mechanical ball latches, and more particularly to a spring loaded electro-mechanical ball latch having a cocking mechanism.

BACKGROUND ART

Electro-mechanical ball latches are known in the prior art. U.S. Pat. No. 5,428,873, entitled "Ball Latch Mechanism," the entire contents of which is incorporated herein by reference, describes such a latch.

BRIEF SUMMARY

With parenthetical reference to corresponding parts, portions or surfaces of the disclosed embodiment, merely for the purposes of illustration and not by way of limitation, an improved ball-latch mechanism (15) is provided comprising: a housing (22); a plunger (17) supported in the housing and having a ball bearing surface (23); the plunger disposed relative to the housing such that the plunger may be moved axially along a longitudinal axis (19) in a linear range of motion (37) from a loaded position (FIG. 5) to an extended position (FIG. 2); a trigger 16) supported in the housing and having a ball bearing surface (24); the trigger disposed relative to the plunger such that the trigger may be rotated about the longitudinal axis from a latched position (FIG. 5) to an unlatched position (FIG. 2); a ball bearing (20) located in contacting relation with the ball bearing surface of the trigger, the ball bearing being radially movable relative to the longitudinal axis between a first position (FIG. 5), wherein the ball bearing interferes with the bearing surface of the plunger when the trigger is in the latched position and the plunger is in the loaded position, and a second position (FIG. 2), wherein the ball bearing is retracted when the trigger is in the unlatched position permitting axial movement of the plunger from the loaded position; a bias element (25) biasing the plunger axially from the loaded position; a cocking mechanism (26) supported in the housing and comprising a lever arm (28) having a plunger bearing surface (29) and a torque receiving surface (30), the lever arm being rotatable about a lever axis (21) substantially perpendicular to the longitudinal axis; and the lever arm rotatable about the lever axis from a retracted position (FIG. 2) within the housing, wherein the plunger bearing surface of the lever arm is outside of the range of motion of the plunger, and a cocked position (FIG. 4), wherein the plunger bearing surface of the lever arm bears against the plunger and the plunger is in the loaded position; whereby the plunger may be forced to the loaded position by the lever arm by application of torque to the torque receiving surface; and whereby the trigger may be rotated to the latched position with the ball bearing in the first position to latch the plunger in the loaded position.

The ball-latch mechanism may further comprise an actuator (31) configured to rotate the trigger relative to the plunger to the unlatched position, and the actuator may comprise a solenoid. The bias element may comprise a coil spring. The torque receiving surface may comprise a hex nut. The lever axis may not intersect the longitudinal axis of the plunger and the lever axis may be closest to the longitudinal axis between the loaded position and the extended position of the plunger. The cocking mechanism may comprise a second bias element (32) biasing the lever arm to the retracted position within the housing, and the second bias element may comprise a torsional spring. The cocking mechanism may comprise a clevis member (33) in the housing having two openings and the lever arm may comprise a shaft (34) orientated about the lever axis and extending through the openings in the clevis member. The torque receiving surface of the lever arm may comprise a nut at a first end of the shaft. The plunger bearing surface of the lever arm may comprise a roller bearing.

DETAILED DESCRIPTION OF THE EMBODIMENTS

Figure 1:
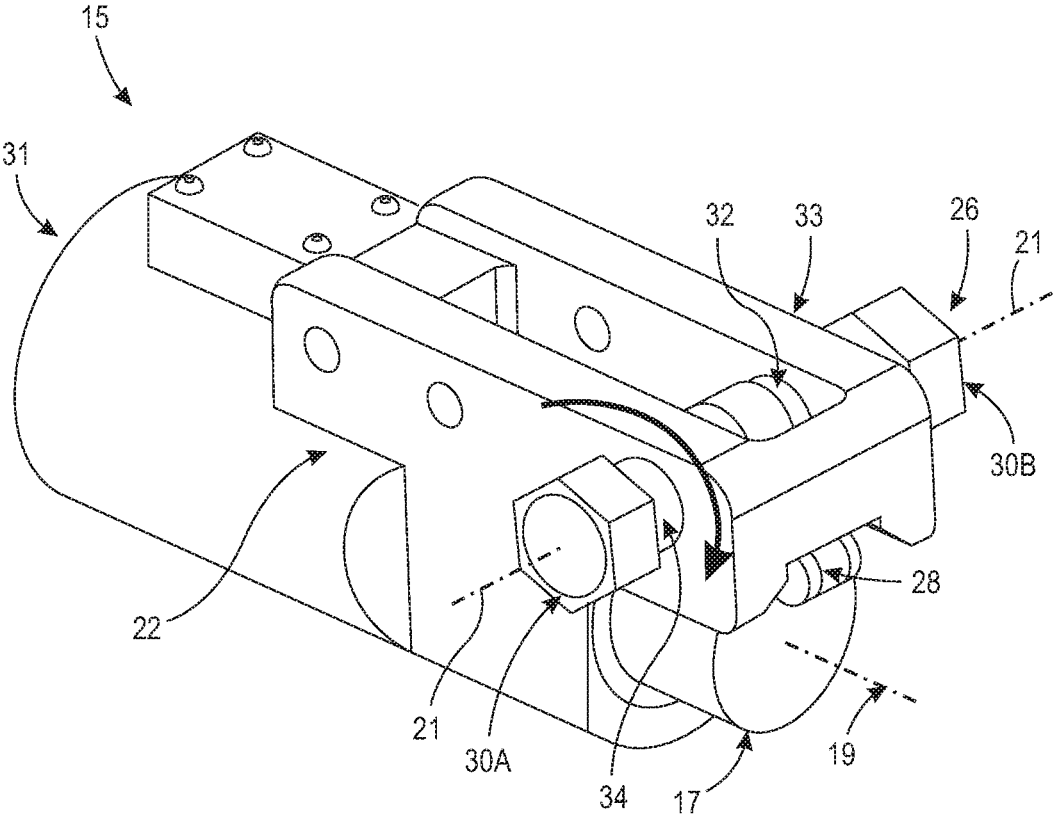
FIG. 1 is a perspective view of a first embodiment of an improved ball-latch mechanism.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., crosshatching, arrangement of parts, proportion, degree, etc.) together with the specification, and are to be considered a portion of the entire written description of this disclosure. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to FIGS. 1-5, an improved ball latch is disclosed, a first embodiment of which is generally indicated at 15. Ball latch 15 generally includes housing 22 supporting spring loaded outer tubular plunger 17, inner cylindrical trigger 16, cage 18 concentrically located between tubular plunger 17 and inner trigger 16, rotary solenoid 31 and cocking mechanism 26.

Figure 2:
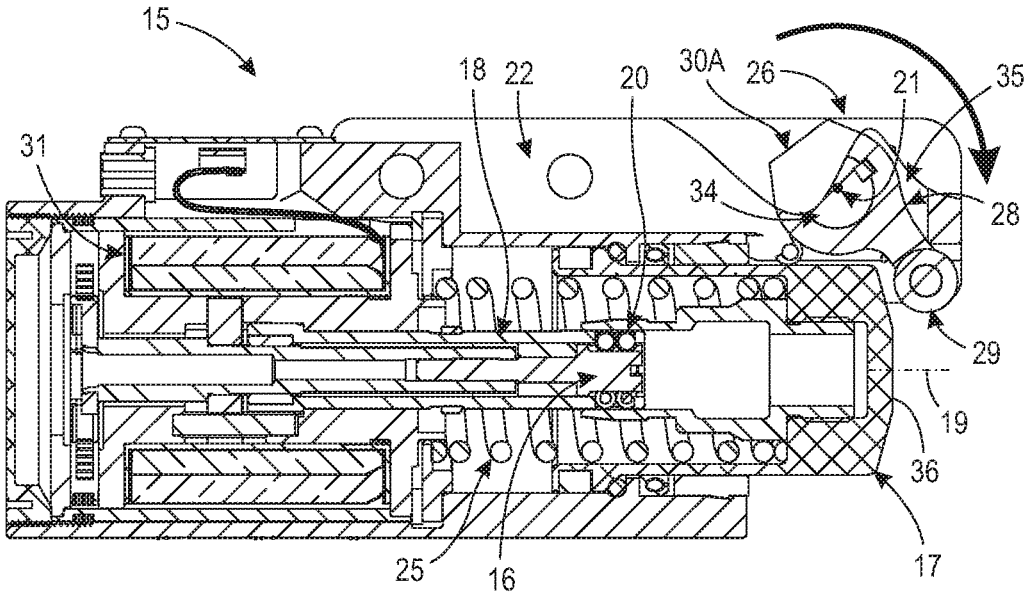
FIG. 2 is a vertical longitudinal sectional view of the mechanism shown in FIG. 1, in a trigger unlatched position, plunger extended position and a lever arm retracted position.

Cage 18 has a plurality of circumferentially arranged apertures for receiving spherical balls 20. An inner wall of plunger 17 has grooves that may be aligned with the apertures of cage 18 for receiving balls 20. Similarly, an outer wall of inner trigger 16 has channels for receiving balls 20. In the latched condition shown in FIG. 5, balls 20 are simultaneously disposed in the apertures of cage 18 and the grooves of outer tubular plunger 17, thereby preventing any relative axial linear movement along axis 19 between the two. To unlatch tubular plunger 17 from cage 18, inner cylindrical trigger 16 is rotated by rotary solenoid 31 relative to cage 18 such that the channels of inner cylindrical trigger 16 are aligned with balls 20. In this unlatched position, balls 20 are permitted to retract radially inward from the grooves of outer tubular plunger 17 below the outer surface of cage 18 and into the channels in inner cylindrical trigger 16, as shown in FIG. 2, such that outer tubular plunger 17 is released and is thereby free to move axially past balls 20. A large axial load is applied to outer tubular plunger 17 by coil spring 25 in the latched condition which, upon unlatching, causes an immediate and powerful axial movement of outer tubular plunger 17 and its end face 36 to the right along axis 19 with respect to cage 18 and housing 22. Thus, outer plunger 17 is spring-loaded by spring 25 and when released will move rapidly axially from left to right to the extended position, shown in FIGS. 2 and 3.

Figure 4:
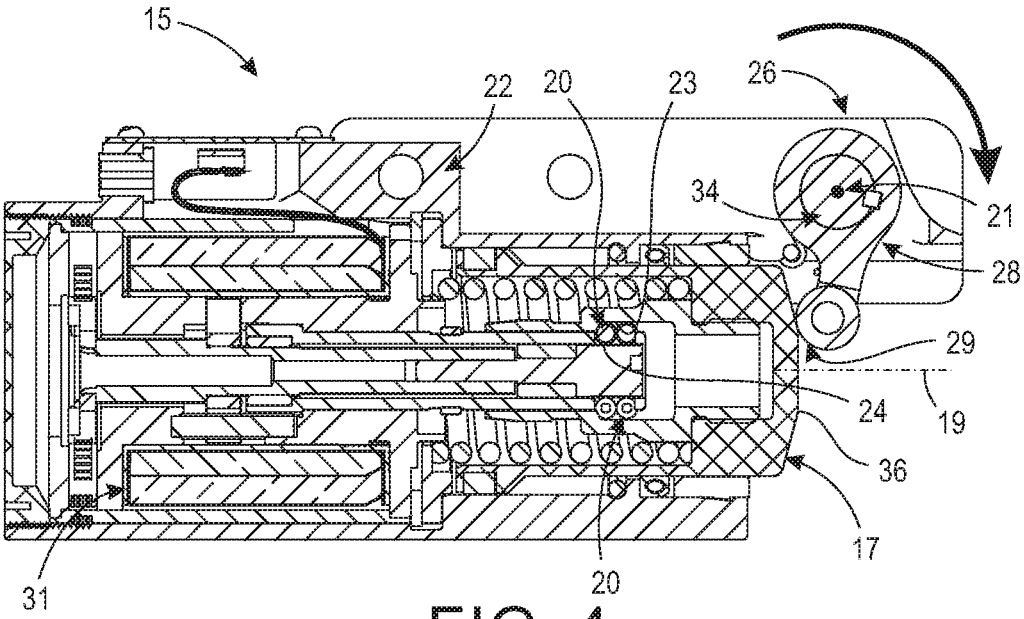
FIG. 4 is a view of the mechanism shown in FIG. 2 in a trigger latched position, plunger loaded position and lever arm cocked position.
Figure 5:
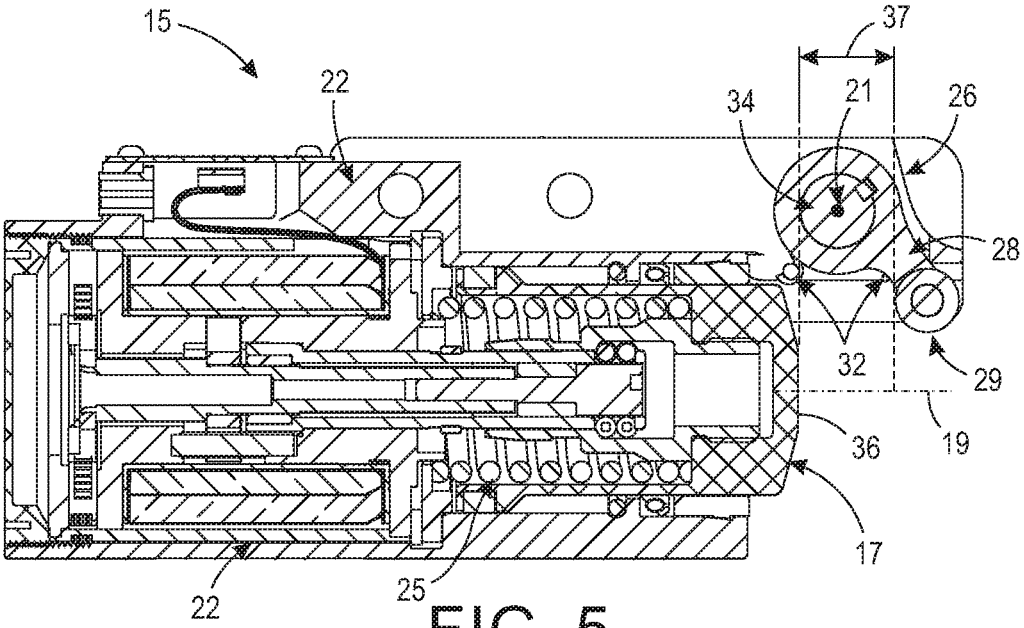
FIG. 5 is a view of the mechanism shown in FIG. 2 in a trigger latched position, plunger loaded position and lever arm retracted position.

In order to place the latch in the latched or cocked position, shown in FIGS. 4 and 5, plunger 17 must be forced axially to the left against the force of coil spring 25 until the grooves in plunger 17 are positioned over the slots of cage 18. Trigger 16 is then rotated by rotary solenoid 31 until the channels of inner cylindrical trigger 16 and the slots of cage 18 are out of alignment, forcing latch balls 20 by cam action into contact with the grooves in plunger 17, thereby locking plunger 17 in the latched or cocked position. In this position, plunger 17 is prevented from moving to the right due to the interference caused by latch balls 20 protruding through cage 18 and engaging the groves in plunger 17.

As shown, cocking mechanism 26 is used to push plunger 17 to the left against coiled spring 25 to the loaded position shown in FIG. 4. As shown, cocking mechanism 26 comprises two outer cocking nuts 30*a* and 30*b* on either end of shaft 34, which is supported by clevis member 33 and rotatable relative to housing 22 and clevis 33 about lever axis 21, lever arm 28 extending from rotating shaft 34 and having roller bearing end 29, and lever return spring 32 configured to bias lever 28 to rotate in the counter clockwise direction about lever axis 21 absent a counter force. Cocking mechanism 26 is integrated into the unit and shares the same housing 22 as solenoid 31 and ball latch components 16, 18, 20 and 31. Cocking nuts 30A and 30B are positioned outside of unit housing 22 so that they are easily accessible on either side and may be rotated with a conventional wrench from either side. Lever axis 21 is substantially perpendicular to longitudinal axis 19 of plunger 17. As shown, lever axis 21 is in a horizontal plane above the horizontal plane of longitudinal axis 19 such that lever axis 21 and longitudinal axis 19 do not intersect. As shown in FIG. 5, end face 36 of plunger 17 has operational range of motion 37 along longitudinal axis 19 from its loaded position shown in FIG. 5 to its extended position shown in FIG. 2. Lever axis 21 is in a vertical plane that intersect longitudinal axis 19 between the loaded position shown in FIG. 5 and the extended position shown in FIG. 2, such that lever axis 21 is closest to longitudinal axis 19 between the loaded position and the extended position of end face 36 of plunger 17.

Figure 3:
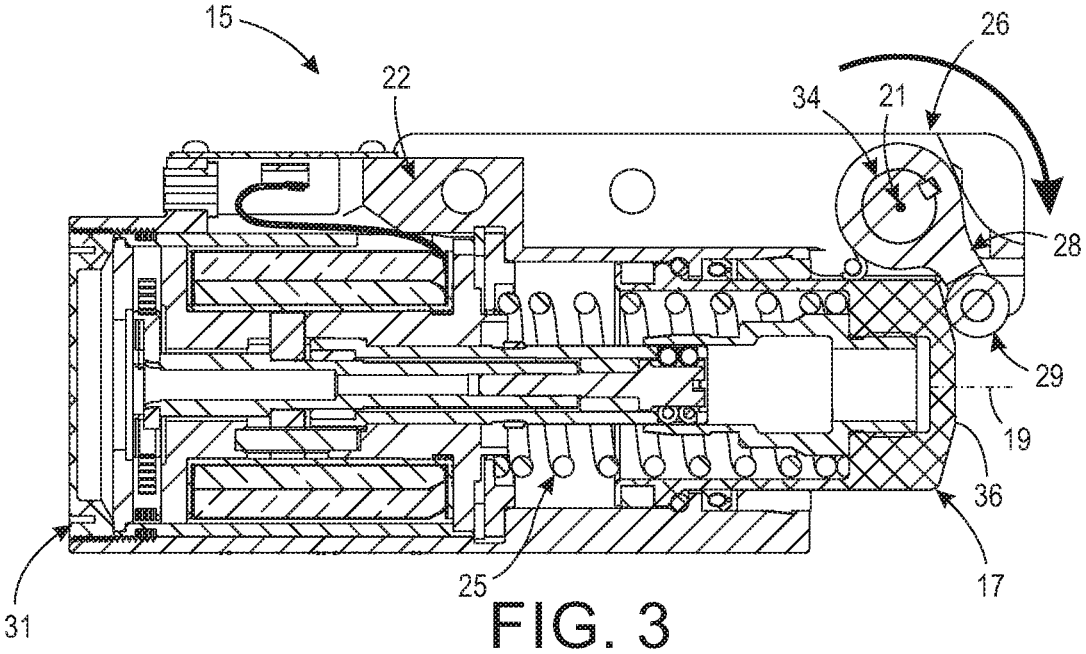
FIG. 3 is a view of the mechanism shown in FIG. 2 in a position in which the lever arm engages the plunger shown in FIG. 2.

As shown, rotation of at least one of cocking nuts 30A or 30B in the clockwise direction about axis 21 causes roller bearing 29 at the end of lever arm 28 to bear against the right end face of plunger 17, as shown in FIG. 3. Further rotation in the clockwise direction about axis 21 applies an axial force from right to left and compresses spring 25 and moves plunger 17 into its latched position, as shown in FIG. 4. Trigger 16 is then rotated to hold plunger 17 in the latched position as described above. Once plunger 17 is in the latched position, nut 30A or 30B may be released. Torsional lever return spring 32 causes nut 30A and lever arm 28 to rotate in the counterclockwise direction about lever axis 21 such that roller bearing 29 at the end of lever arm 28 is away from plunger 17 and lever arm 28 is retracted into corresponding recess 35 in housing 22. As shown, cocking mechanism 16 has a low-profile so that it fits into the space available and such that lever arm 28 and roller bearing 29 are out of the way of the range of motion of plunger 17 once ball latch mechanism 15 is in the latched position. In the retracted position of FIG. 2, bearing surface 29 of lever arm 28 is outside of the range of motion of plunger 17. Thus, lever 28 that pushes plunger 17 back into the latched position retracts into recess 35 in housing 22 of cocking mechanism 26. Plunger 17 may be forced to the loaded position by lever arm 28 by application of torque to hex nut 30A and/or 30B and trigger 16 may then be rotated to the latched position with ball bearings 20 in position to latch plunger 17 in the loaded position Cocking mechanism 26 provides a number of benefits. Due to the mechanical advantage of lever arm 28, less force is required to cock or latch the ball latch. Mechanism 26 allows the ball latch to be cocked using a standard wrench or driver with about 4 pounds of force instead of the 30 to 32 pounds of force presently required without such mechanism. Mechanism 26 has a low profile and is integrated into solenoid unit housing 22 and is moved out of the way once the ball latch is cocked.

The present invention contemplates that many changes and modifications may be made. Therefore, while forms of the improved ball latch have been shown and described, and a number of alternatives discussed, persons skilled in this art will readily appreciate that various additional changes and modifications may be made without departing from the scope of the invention, as defined and differentiated by the following claims.

What is claimed is:

1. A ball-latch mechanism comprising:

a housing;

a plunger supported in said housing and having a ball bearing surface;

said plunger disposed relative to said housing such that said plunger is movable axially along a longitudinal axis in a linear range of motion from a loaded position to an extended position;

a trigger supported in said housing and having a ball bearing surface;

said trigger disposed relative to said plunger such that said trigger is rotatable about said longitudinal axis from a latched position to an unlatched position;

an actuator configured to rotate said trigger relative to said plunger to said unlatched position;

a ball bearing located in contacting relation with said ball bearing surface of said trigger, said ball bearing being radially movable relative to said longitudinal axis between a first position, wherein said ball bearing interferes with said bearing surface of said plunger when said trigger is in said latched position and said plunger is in said loaded position, and a second position, wherein said ball bearing is retracted when said trigger is in said unlatched position permitting axial movement of said plunger from said loaded position;

a first bias element biasing said plunger axially from said loaded position;

a cocking mechanism supported in said housing;

said cocking mechanism comprising a lever arm extending from a shaft orientated about a lever axis that is substantially perpendicular to said longitudinal axis, such that said lever arm operatively rotates about said lever axis relative to said housing with rotation of said shaft about said lever axis relative to said housing;

said lever arm having a plunger bearing surface and said shaft having a torque element defining a torque receiving surface;

said lever arm being rotatable about said lever axis by application of a torque to said torque receiving surface of said torque element of said cocking mechanism;

said cocking mechanism comprises a second bias element biasing said lever arm to said retracted position within said housing; and said lever arm rotatable about said lever axis from a retracted position within said housing, wherein said plunger bearing surface of said lever arm is outside of said range of motion of said plunger, and a cocked position, wherein said plunger bearing surface of said lever arm bears against said plunger and said plunger is in said loaded position;

whereby said plunger is operatively configured to be forced to said loaded position by said plunger bearing surface of said lever arm by application of torque to said torque receiving surface of said cocking mechanism;

whereby said lever arm is operatively biased to said retracted position by said second bias element with release of said application of torque to said torque receiving surface of said torque element; and whereby said trigger is operatively configured to be rotated to said latched position with said ball bearing in said first position to latch said plunger in said loaded position.

2. The ball-latch mechanism of claim 1, wherein said actuator comprises a solenoid.

3. The ball-latch mechanism of claim 1, wherein said first bias element comprises a coil spring.

4. The ball-latch mechanism of claim 1, wherein said torque element comprises a hex nut.

5. The ball-latch mechanism of claim 1, wherein said lever axis does not intersect said longitudinal axis of said plunger and said lever axis is closest to said longitudinal axis between said loaded position and said extended position of said plunger.

6. The ball-latch mechanism of claim 1, wherein said second bias element comprises a torsional spring.

7. The ball-latch mechanism of claim 1, wherein said cocking mechanism comprises a clevis member in said housing having two openings and said shaft orientated about said lever axis extends through said openings in said clevis member.

8. The ball-latch mechanism of claim 7, wherein said torque element of said cocking mechanism comprises a nut at a first end of said shaft.

9. The ball-latch mechanism of claim 1, wherein said plunger bearing surface of said lever arm comprises a roller bearing.

* * * * *